US007513753B2

(12) United States Patent
Shin et al.

(10) Patent No.: US 7,513,753 B2
(45) Date of Patent: Apr. 7, 2009

(54) VARIABLE CAPACITY SCROLL COMPRESSOR

(75) Inventors: Dong Koo Shin, Gyeonggi-do (KR); Cheol Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 683 days.

(21) Appl. No.: 10/832,379

(22) Filed: Apr. 27, 2004

(65) Prior Publication Data

US 2005/0019178 A1 Jan. 27, 2005

(30) Foreign Application Priority Data

Jul. 26, 2003 (KR) ..... 10-2003-0051773

(51) Int. Cl.
*F04B 39/00* (2006.01)

(52) U.S. Cl. ..... 417/310; 417/440; 417/410.5

(58) Field of Classification Search ..... 417/410.5, 417/310, 440, 426

See application file for complete search history.

(56) References Cited

U.S. PATENT DOCUMENTS 4,560,330 A * 12/1985 Murayama et al. ..... 418/55.1
5,639,225 A * 6/1997 Matsuda et al. ..... 417/299
6,149,401 A * 11/2000 Iwanami et al. ..... 417/307
6,685,441 B2 * 2/2004 Nam ..... 417/292
2002/0071773 A1 * 6/2002 Matsuba et al. ..... 417/310
2003/0035736 A1 * 2/2003 Nam ..... 417/310
2003/0202886 A1 10/2003 Choi

FOREIGN PATENT DOCUMENTS

| | | |
|---|---|---|
| JP | 57-110789 | 7/1982 |
| JP | 5-180182 | 7/1993 |
| JP | 11-351167 | 12/1999 |
| KR | 1991-2403 | 4/1991 |

OTHER PUBLICATIONS

English language Abstract of JP 57-110789.
English language Abstract of JP 11-351167.
English language Abstract of JP 5-180182.

* cited by examiner

*Primary Examiner*—Charles G Freay
*Assistant Examiner*—Peter J Bertheaud
(74) *Attorney, Agent, or Firm*—Greenblum & Bernstein, P.L.C.

(57) ABSTRACT

Disclosed is a variable capacity scroll compressor in which a high-pressure fluid within a thermodynamic cycle is introduced into the inside of the compressor to increase the compression volume and also the fluid inhaled/exhausted from the compressor allows the fluid being compressed to be bypassed in multi-stages, thereby varying the capacity of the compression fluid.

7 Claims, 10 Drawing Sheets

VARIABLE CAPACITY SCROLL COMPRESSOR

BACKGROUND OF THE INVENTION

1. Field of the Invention

The present invention relates to a scroll compressor, and more particularly, to a variable capacity scroll compressor, which is configured to vary an exhaust volume of the compressor in multi-stages.

2. Description of the Related Art

Generally, a cooling system is applied to an air conditioner or a refrigerator to lower the temperature of an enclosed space by absorbing and discharging heat using refrigerant circulating a cooling cycle.

Such a cooling system is configured to perform a series of cycles of compression, condensation, expansion and vaporization of refrigerant. A scroll compressor is used to perform the compression cycle among the series of cycles.

Since the scroll compressor is disclosed in a plurality of published documents, the detailed description on the general structure and operation will be omitted herein.

The reason why the compression capacity of a scroll compressor should be varied will be described hereinafter.

A scroll compressor for a specific use is generally selected by considering the most disadvantageous operation condition when forecasting its use environment, for instance, the greatest compression capacity-requested condition (i.e., a heating operation of an air conditioner using heat pump).

However, it is general that the most disadvantageous condition does not nearly occur in an actual operation. In an actual operation of the compressor, a condition needing a small compression volume (ex. cooling operation of air conditioner) not the most disadvantageous condition exists too.

Thus, when the compressor having a large compression capacity is selected considering the worst condition, the compressor is operated under the low-load condition during an operation period of the high-compression ratio, thereby deteriorating an overall operation efficiency of the system.

Therefore, in order to improve the overall operating efficiency even under a normal operating condition and to accept the operational condition under the most disadvantageous condition, there is a need for a compressor that has a variable compression capacity.

To vary the compression capacity of the scroll compressor, a method for electrically controlling an RPM of the compressor has been most widely used.

Such an electrical control method has an advantage of effectively varying the compression capacity. However, additional components, for instance, an inverter for accurately controlling the RPM of a motor, are required. Furthermore, when the motor rotates with a relatively high RPM, it is difficult to ensure a reliability of frictional portions.

SUMMARY OF THE INVENTION

Accordingly, the present invention is directed to a variable capacity scroll compressor that substantially obviates one or more problems due to limitations and disadvantages of the related art.

An object of the present invention is to provide a variable capacity scroll compressor that can vary a compression capacity using a bypass function in a state where a compressor motor rotates at a constant RPM.

Another object of the present invention is to provide a variable capacity scroll compressor that can vary a compression capacity by operating a valve using either uncompressed low-pressure fluid or compressed high-pressure fluid.

A further object of the present invention is to provide a variable capacity compressor in which the compression capacity is controllable in a multi-stages of two or more stages and thus fluid is able to be compressed depending on a specific compression capacity as requested under variously given operation conditions of cooling system and heat pump system.

A further another object of the present invention is to provide a variable capacity scroll compressor that can operate a scroll motor by varying compression capacity without a motor loss or without providing an additional power.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a variable capacity scroll compressor including: a control passage branched from a condenser and extending to a compression space of the scroll compressor such that high pressure fluid of the condenser flows therethrough; an injection port having one end contacting the control passage and other end contacting the compression space of the scroll compressor; an injection valve formed in the injection port, for allowing fluid to flow when the high pressure fluid is applied from the control passage, while allowing the fluid not to flow when the high pressure fluid is not applied from the control passage; one or more bypass ports formed along the compression space of the scroll member, the bypass port allowing fluid in compression to be bypassed at one or more points; a bypass passage having one end connected to the bypass port and the other end connected to a lower pressure side inside the compressor; a check valve for selectively connecting the bypass passage to the bypass port; and a control valve for allowing at least high pressure fluid of an exhaust passage of the scroll compressor to be selectively applied to the check valve so as to control the check valve to one of opening and closing positions.

In another aspect of the present invention, there is provided a variable capacity scroll compressor including: a control passage branched from a condenser and extending to a compression space of the scroll compressor such that high-pressure fluid of the condenser flows therethrough; an injection port having one end contacting the control passage and other end contacting the compression space of the scroll compressor; and an injection valve for controlling injection of the fluid through the injection port.

In a further aspect of the present invention, there is provided a variable capacity scroll compressor including: a control passage to which low/high pressure fluid before/after compression by the compressor is selected by a valve and is applied; a check valve for selectively opening/closing a compression path of a scroll member by the control passage; and an injection valve for allowing the high pressure fluid selected by the valve to be inhaled into a compression space of the compressor through an injection port.

According to the present invention, the compression capacity of the scroll compressor can be easily varied without additional components.

Also, the inventive scroll can vary the compression capacity positively responding to two or more requested operation conditions.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
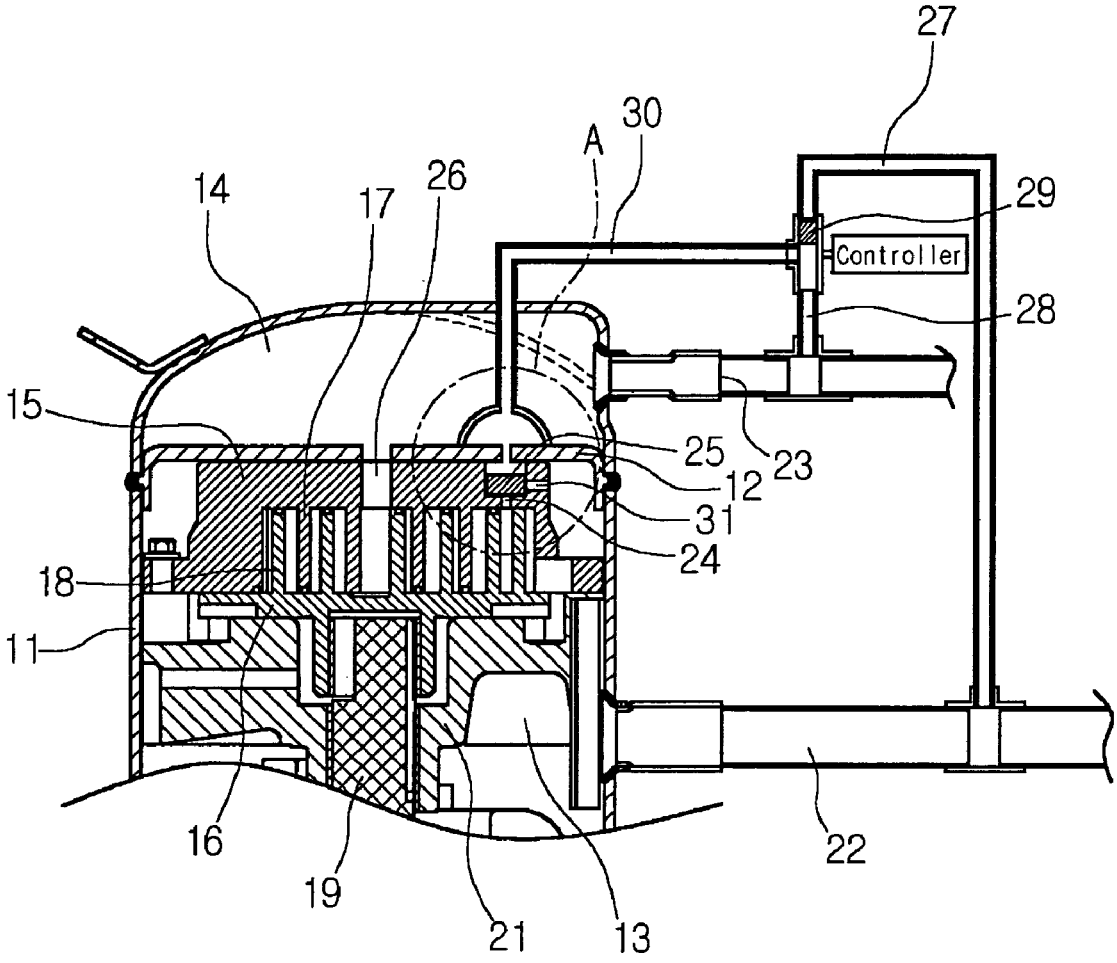
FIG. 1 is a sectional view of a scroll compressor according to an embodiment of the present invention.

FIG. 1 shows a sectional view of a scroll compressor according to an embodiment of the present invention.

Referring to FIG. 1, the inventive variable capacity scroll compressor includes a conventional compressing part, a bypass part for varying a compression capacity, and a bypass control part for controlling the bypass part.

The conventional compressing part includes a seal case 11 for defining an enclosed chamber, a seal plate 12 disposed in the seal case 11 to divide the sealed chamber into a low-pressure intake chamber 13 and a high-pressure exhaust chamber 14, an intake passage 22 connected to the intake chamber 13 to supply fluid to be compressed to the intake chamber 13, an exhaust passage 23 connected to the exhaust chamber 14 to exhaust compressed fluid out of the exhaust chamber 14, a stationary scroll member 15 fixed on an inner circumference of the seal case 11, a driving shaft 19 extending from a motor (not shown) and having an eccentric upper end, an orbiting scroll member 16 associated with the driving shaft 19, a stationary spiral wrap 17 formed on the stationary scroll member 15, a orbiting spiral wrap 18 defining the fluid compressing path by surface-contacting the stationary spiral wrap 17, a bearing 21 for stably supporting the driving shaft 19, and a central exhaust passage 26 formed through a central axis of the stationary scroll member 15 to direct the compressed fluid to the exhaust chamber 14.

The bypass part includes a bypass port 24 formed through a portion of the stationary scroll member 15, a check valve 25 formed on a rear side of the bypass port 24 to control the flowing direction of the fluid, and a bypass passage 31 branched off from the check valve 25 to allow the fluid exhausted through the bypass port 24 to be directed to the intake chamber 13.

The bypass control part includes a control passage 30 for forming control pressure for controlling an opening/closing operation of the check valve 25 and a control valve 29 for allowing the control pressure formed on the control passage 30 to be selectively supplied from one of the low-pressure and high-pressure passages 27 and 28. The control passage 30 is formed penetrating the seal plate 12 to communicate with a compressing space of the conventional compressing part.

Particularly, the low-pressure passage 27 has a first end connected to the control valve 29 and a second end connected to the intake passage 22 so that low-pressure of the intake passage 22 can be applied to the low-pressure passage 27. The high-pressure passage 28 has a first end connected to the control valve 29 and a second end connected to the exhaust passage 23 so that high-pressure of the exhaust passage 23 can be applied to the high-pressure passage 28.

Meanwhile, the check valve 25 may be formed of a float valve having a floating member moving in a direction where pressure is applied to change a passage connection state.

For example, as shown in the drawing, a cylindrical floating body is disposed in a cylindrical housing, being movable in a direction where low-pressure is applied.

Alternatively, a check ball may be movably disposed in a housing so that a fluid passage opening can be opened or closed by the check ball. That is, any types of valves that are designed to be controlled by pressure can be employed to the present invention.

In addition, the control valve 29 can be formed of a solenoid valve controlled by a predetermined controller.

The operation of the above described variable capacity scroll compressor will be described hereinafter.

When the driving shaft 19 is rotated by the motor (not shown), the orbiting scroll member 16 associated with the driving shaft 19 rotates. At this point, the stationary scroll member 15 is in a fixed state.

When the orbiting scroll member 16 rotates, low-pressure fluid stored in the intake chamber 13 is directed into a space defined between the orbiting spiral wrap 18 formed on the orbiting scroll member 16 and the stationary spiral wrap 17 formed on the stationary scroll member 15, and is then compressed in the space.

The compressed fluid is directed into the exhaust chamber 14 through the central exhaust passage 26 formed through the central axis of the stationary scroll member 15, and the high-pressure fluid in the exhaust chamber 14 is exhausted through the exhaust passage 23.

Meanwhile, when the check valve 25 is closed (when the check valve 25 is moved downward in the drawing), the fluid cannot be exhausted through the bypass port 24. However, when the check valve 25 is opened (when the check valve 25 is moved upward in the drawing), the fluid is exhausted through the bypass port 24, and is then bypassed into the intake chamber 13 through the bypass passage 31. Therefore, when the check valve 25 is opened, the compression capacity is reduced.

To control the operation of the check valve 25, the bypass control part further includes a control passage, one end of which is connected to the check valve 25 to applied control pressure to the check valve 25. The control valve 29 is formed on the other end of the control passage 30. By the control valve 29, one of the fluid pressures from the low-pressure and high-pressure passages 27 and 28 is selected and applied to the control passage 30.

Particularly, the low-pressure and high-pressure passages 27 and 28 are respectively connected to the intake and exhaust passages 22 and 23 such that low-pressure fluid that is not compressed in the conventional compressing part and high-pressure fluid that is compressed in the conventional compressing part can be respectively supplied to the low-pressure and high-pressure passages 27 and 28. As a result, the control passage 30 is selectively supplied with one of the low-pressure and high-pressure fluids in the respective low-pressure and high-pressure passages 27 and 28.

Describing more in detail, when the high-pressure passage 28 is connected to the control passage 30 by the control valve moved upward in FIG. 1, since the control passage 30 is supplied with the high-pressure, the check valve 25 is closed by moving downward. When the check valve 25 is closed, since the bypass port 24 is closed, the fluid being compressed cannot be bypassed. As a result, a relatively large amount of fluid can be compressed without any compression capacity loss.

When the low-pressure passage 27 is connected to the control passage 30 by the control valve moved downward FIG. 1, since the low-pressure is applied to the control passage 30, the check valve 25 is opened by moving upward in FIG. 1. That is, pressure of fluid being compressed by a mutual operation of the scroll members 15 and 16 is lower than that in the intake pressure 22, the check valve 25 that is the floating valve is opened.

In addition, when the check valve 25 is opened, since the bypass port 24 is opened, the fluid being compressed is bypassed into the intake chamber 13 through the bypass passage 31. Therefore, the compression capacity is reduced as much as an amount of fluid bypassed.

Figure 2:
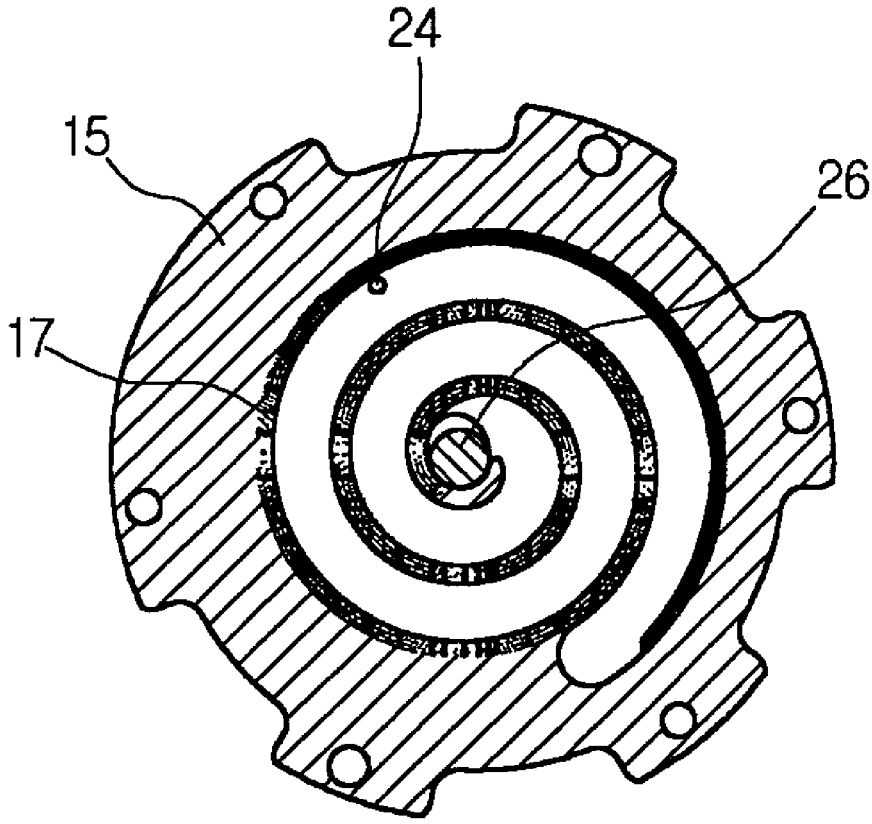
FIG. 2 is a bottom view of a stationary scroll member depicted in FIG. 1.

FIG. 2 shows a bottom view of the stationary scroll member 15 depicted in FIG. 1.

As shown in the drawing, the stationary spiral wrap 17 is formed on the stationary scroll member 15, and the central exhaust passage 26 is formed through the central portion of the stationary spiral wrap 17. The bypass port 24 is formed on the scroll member in a compression space defined by the stationary spiral wrap 17, thereby allowing the fluid being compressed to be bypassed.

Hereinbelow, operation of the pressure-variable scroll member will be described in detail.

Figure 3:
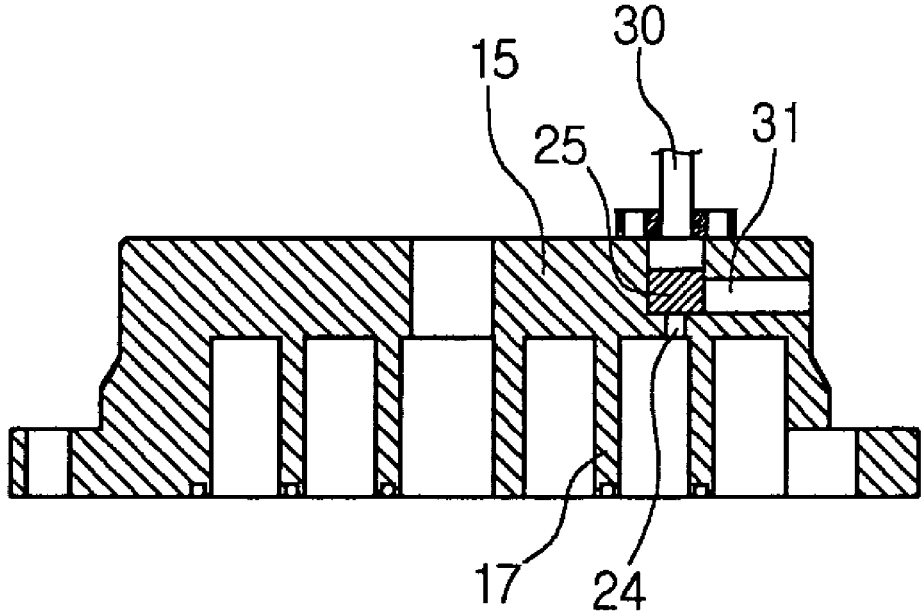
FIG. 3 is an enlarged view of a portion "A" of FIG. 1, in which a bypass port is closed.
Figure 4:
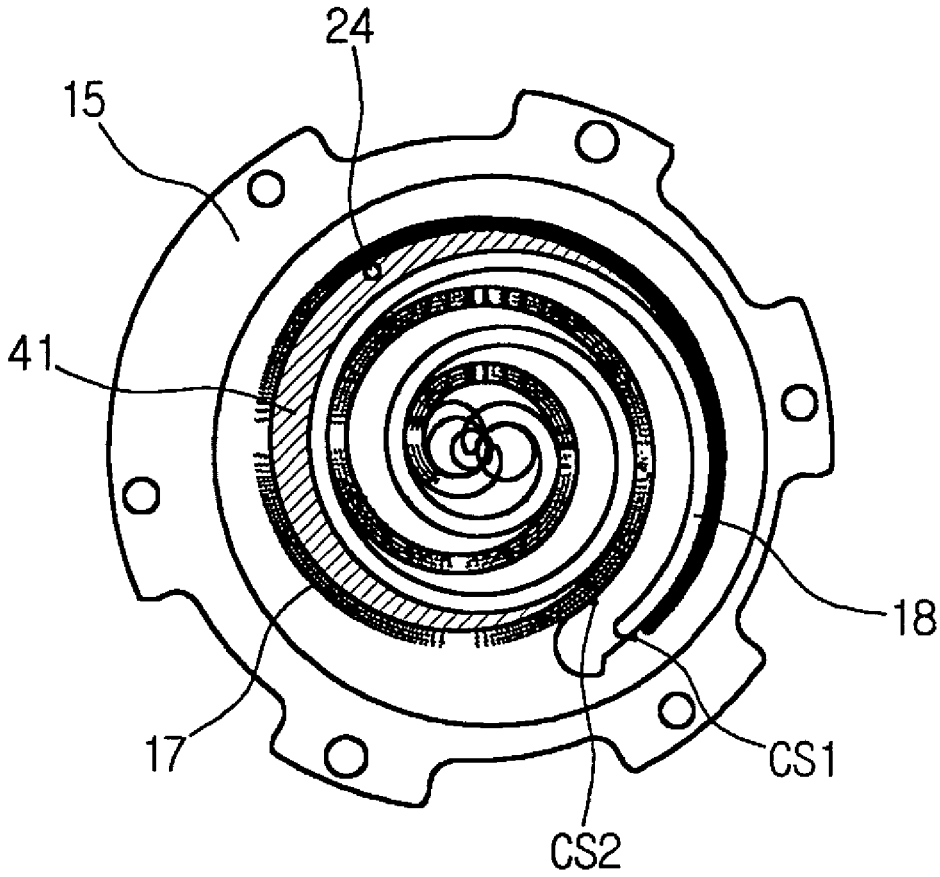
FIG. 4 is a schematic view conceptually illustrating a state of a scroll member when a bypass port is closed.
Figure 5:
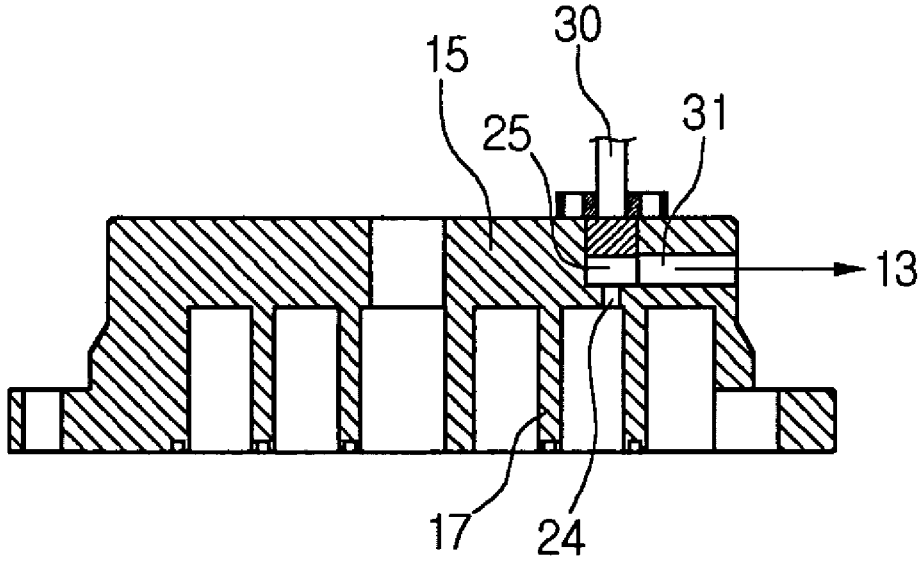
FIG. 5 is an enlarged view of a portion "A" of FIG. 1, in which a bypass port is opened.
Figure 6:
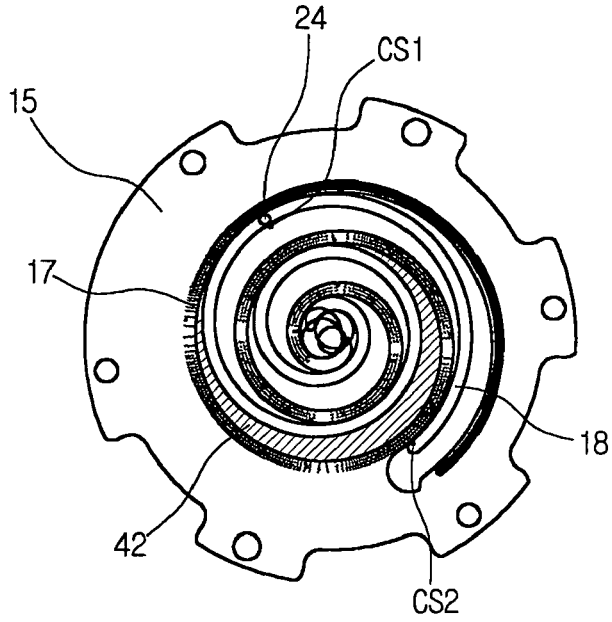
FIG. 6 is a view conceptually illustrating a state of a scroll member when a bypass port is opened.

FIGS. 3 and 5 show enlarged views of a portion "A" in FIG. 1, and FIGS. 4 and 6 show views conceptually illustrating a scroll member according to opening and closing states of a bypass port. FIGS. 3 and 4 show a state where the bypass port is closed, and FIGS. 5 and 6 show a state where the bypass port is opened.

Referring to FIG. 3, the bypass port 24 is formed at a position between spaced parts of the spiral wrap 17, and is in a closed state by the check valve 25. At this time, since high-pressure is applied to the check valve 25 through the control passage 30, the check valve 25 firmly closes the bypass port 24.

Referring to FIG. 4, when the bypass port 24 is closed, a first intake volume 41 that is a compression space defined between the stationary spiral wrap 17 and the orbiting spiral wrap 18 can be formed from a start position where the stationary spiral wrap 17 meets the orbiting spiral wrap 18.

The intake volume will be described more in detail hereinafter.

The intake volume defined between the stationary and orbiting spiral wraps 17 and 18 contacting each other may include two intake volumes.

One is a first intake space defined when an inner circumference of the stationary spiral wrap 17 meets an outer circumference of the orbiting spiral wrap 18. The first intake space can be illustrated as the first intake volume 41 depicted in FIG. 4.

The other is a second intake space (not shown) when an outer circumference of the stationary spiral wrap 17 meets an inner circumference of the orbiting spiral wrap 18. Although the second intake space is not shown in the drawing, it can be assumed that the second intake space can be formed by the orbiting operation of the orbiting spiral wrap 18. The intake volume will be described more in detail hereinafter.

A start point of the first intake space is defined on a location indicated by the reference character SC1 (Compress Start 1), and a start point of the second intake space is defined on a location indicated by the reference character SC2 (Compress Start 2. Since the start points SC1 and SC2 are not symmetrically located, this can be called an asymmetry operation mode. That is, when the scroll member is divided into half- and half based on the central portion of the scroll member and both the start points SC1 and SC2 are sided to one half, this can be called the asymmetric operation mode.

Referring to FIG. 5, when the bypass port 24 is opened by the check valve 25 moved upward, since the control passage 30 is supplied with the low-pressure as described above, the check valve 25 is opened to allow the fluid being compressed to be bypassed into the intake chamber 13 through the bypass port 24 and the pass passage 31.

Referring to FIG. 6, in a state where the bypass port 24 is opened, a second intake volume 42 defined between the stationary spiral wrap 42 and the orbiting spiral wrap 18 is not formed from a first position where the stationary spiral wrap 17 firstly meets the orbiting spiral wrap 18. That is, it can be noted that the second intake volume 42 starts to be formed from a position passed over the position where the bypass port 24 is formed.

The intake volume formed when the bypass port is opened will be described more in detail.

In this case, the intake volume defined between the stationary and orbiting spiral wraps 17 and 18 contacting each other may also include two volumes.

One is a first intake space defined when an inner circumference of the stationary spiral wrap 17 meets an outer circumference of the orbiting spiral wrap 18. The first intake space can be illustrated as the second intake volume 42 depicted in FIG. 6.

The other is a second intake space (not shown) when an outer circumference of the stationary spiral wrap 17 meets an inner circumference of the orbiting spiral wrap 18. Although the second intake space is not shown in the drawing, it can be assumed that the second intake space can be formed by the orbiting operation of the orbiting spiral wrap 18.

In addition, since the bypass port 24 is formed near the inner circumference of the stationary spiral wrap, it does not interfere with the formation of the second intake space. In other words, since the bypass port 24 is closed by the orbiting spiral wrap 18 when the second intake space is formed, the second intake space is not affected by the presence of the bypass port 24. In order for the bypass port 24 to be closed by the orbiting spiral wrap 18, the bypass port is formed within the thickness range of the orbiting spiral wrap 18, or is formed on a sidewall of the compression space of the scroll member.

In the beginning of the compression, a start point of the first intake space is defined on a location indicated by the reference character CS1, and a start point of the second intake space is formed on a location indicated by the reference character CS2. That is, the start points CS1 and CS2 are symmetrically located based on the centers of the scroll members 15 and 16. This can be called a symmetry operation mode.

Meanwhile, in order to realize the perfect symmetry operation mode, the bypass port 24 is formed on an opposite side of a spiral start point of the stationary spiral wrap 17 based on the center of the stationary scroll member 15.

When comparing the first intake volume 41 depicted in FIG. 4 with the second intake volume 42 depicted in FIG. 6, it can be noted that they are different from each other.

The first intake volume 41 is greater than the second intake volume 42. This shows that, in the asymmetry operation mode, much more fluid can be compressed. However, the second intake space formed in the asymmetry operation mode may be identical to that formed in the symmetry operation mode.

That is, since the volume of the intake space is varied according to a state (an open/close state) of the bypass port 24, the compression volumes defined by the first intake volume 41, formed when the bypass port is closed, and by the second intake volume 42, formed when the bypass port is opened, are difference from each other.

According to a series of tests, it was noted that, when the bypass port is formed on the location proposed in the drawing, the compression volume obtained by performing the compression using a possible maximum volume tolerance (whole load) in a state where the bypass port 24 is closed is increased by 18% as compared with that obtained by performing the compression using a part of the compressible volume (a partial load) in a state where the bypass port 24 is opened.

That is, the operation of the scroll compressor is changed into one of the symmetry and asymmetry operation modes according to a variety of factors such as the opening/closing state of the bypass port 24, the opening/closing state of the check valve 25, and the control state of the control valve 29. In addition, the intake volume of the scroll compressor is increased or decreased in accordance with the opening/closing state of the bypass port 24, thereby varying the compression volume of the scroll compressor.

For example, when the control valve 29 is controlled such that the high-pressure passage 28 is connected to the control passage 30, the check valve 25 moves downward in the drawing, and the bypass port 24 is closed. The start points of the first and second intake spaces are asymmetrically located to operate the scroll compressor in the asymmetry operation mode, thereby increasing the compression volume. Therefore, this asymmetry operation mode is suitable for, for example, a heating mode of an air conditioner where a relatively large amount of compression volume is required.

When the control valve 29 is controlled such that the low-pressure passage 27 is connected to the control passage 30, the check valve 25 moves upward in the drawing, and the bypass port 24 is opened. The start points of the first and second intake spaces are symmetrically located to operate the scroll compressor in the symmetry operation mode, thereby reducing the compression capacity. Therefore, this symmetry operation mode is suitable for, for example, a cooling mode of the air conditioner where a relatively amount of compression volume is required.

The application of the compressor of the present invention is not limited to the air conditioner that is used only for a description example. That is, the inventive compressor can be applied to any systems requiring a variable compression capacity.

Figure 7:
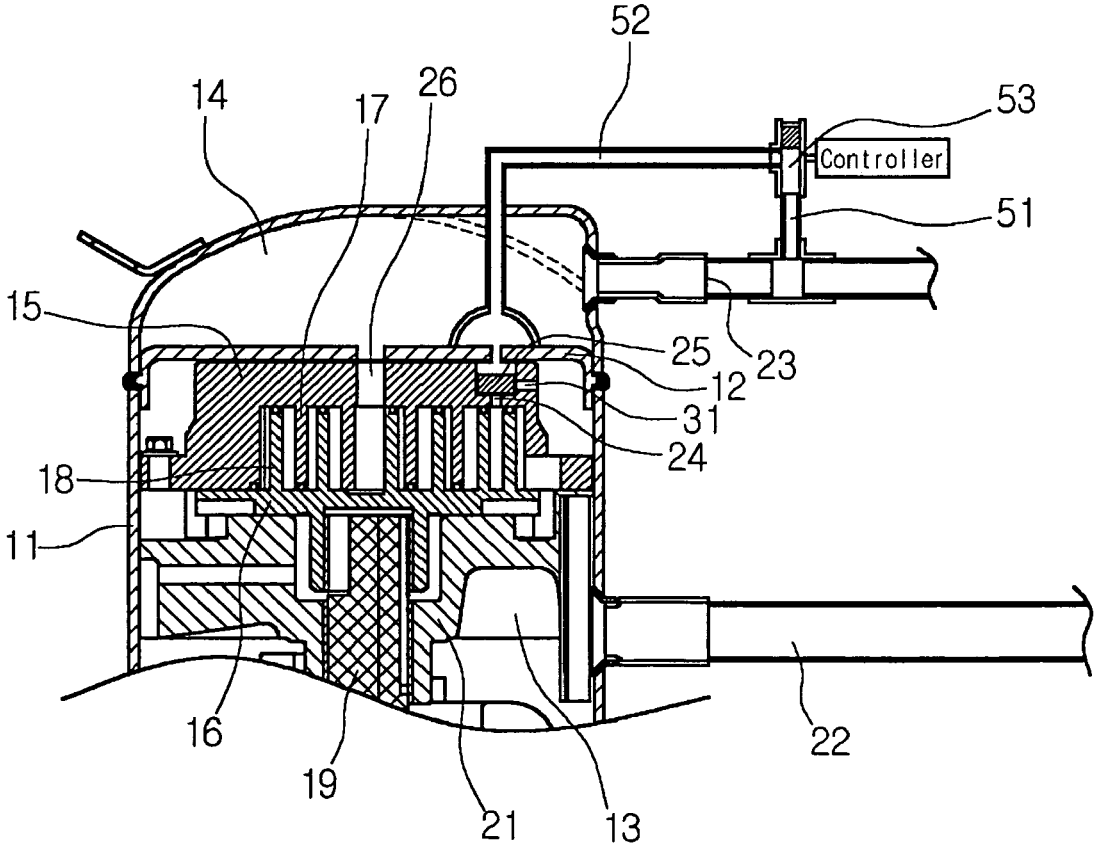
FIG. 7 is a sectional view of a scroll compressor according to another embodiment of the present invention.

FIG. 7 shows a scroll compressor according to a second embodiment of the present invention.

As shown in the drawing, the scroll compressor of this embodiment is identical to that of the first embodiment except for a connection structure around the control valve.

That is, a control passage 52, a control valve 53, and a high-pressure passage 51 are same as those in the first embodiment. However, the low-pressure passage 27 that is selectively connected to the control passage by the control valve in the first embodiment is not formed in this embodiment.

When the low-pressure passage 27 is not formed, the low-pressure of the intake passage 22 is not applied to the control passage 52 even when the control valve 53 moves downward in the drawing.

In such a case, since internal pressure of the control passage 52 is the pressure of a point where the bypass port 24 is formed and is lower than medium-pressure of fluid being compressed, the check valve 25 can be opened.

For this purpose, the check valve 25 can employ a floating valve that is freely movable within a housing.

Figure 8:
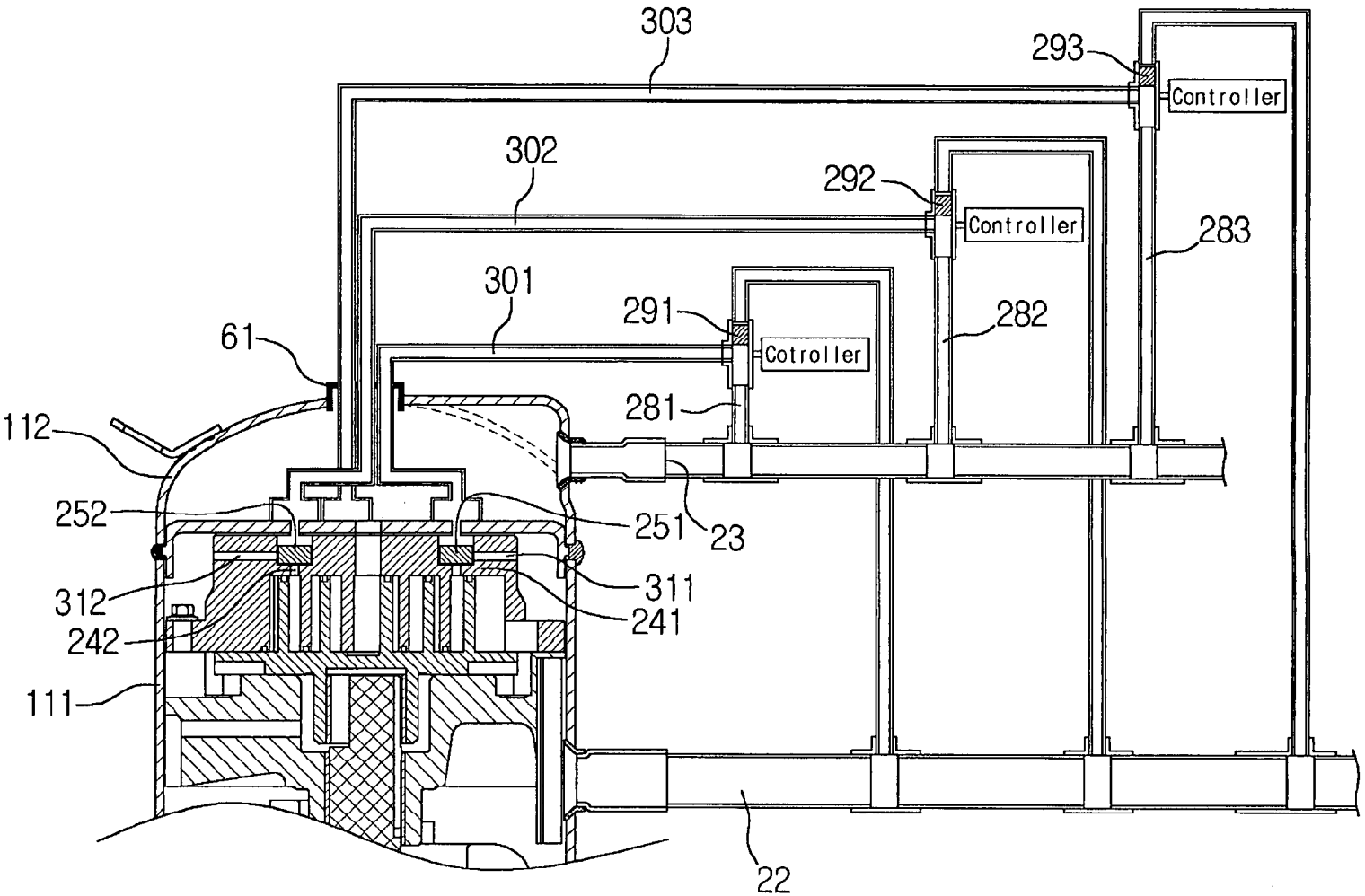
FIG. 8 is a sectional view of a scroll compressor according to another embodiment of the present invention.

FIG. 8 is a sectional view of a scroll compressor according to another embodiment of the present invention.

Referring to FIG. 8, the present embodiment has the same constitution in many parts as the previous embodiment described with reference to FIGS. 1 to 7. In particular, both the embodiments are the same in that fluid that is being compressed by the scroll compressor is bypassed in a middle stage so that compression is not performed prior to the middle stage.

In addition to the above matter, the present embodiment is characterized in that two or more control passages, control valves, low-pressure passages, high-pressure passages, bypass ports and the like are employed in a single scroll compressor and thus a difference in the compression volume depending on the amount of bypassed refrigerant and the amount of compressed refrigerant is controlled in a multi-stage operation.

In other words, a plurality of bypass ports are manipulated individually such that refrigerant being compressed is bypassed through the respective bypass ports at different states, thereby controlling the amount of bypassed refrigerant in a multi-stage operation.

Describing in more detail, as a first bypass structure that permits fluid being compressed by a scroll member to be bypassed, a first bypass port 241, a first check valve 251, a first bypass passage 311, a first control passage 301, a first control valve 291, a first high-pressure passage 281 and a first low-pressure passage 271 are formed.

By manipulating the flow passage of the aforementioned first bypass structure, fluid is bypassed while being compressed by orbiting/stationary movement of the scroll members 15, 16 so that compression capacity can be varied. Since the remaining constitution other than the aforementioned matter is the same as that described in FIGS. 1 to 7, its detailed description is omitted.

Also, as a second bypass structure, a second bypass port 242, a second check valve 252, a second bypass passage 312, a second control passage 302, a second control valve 292, a second high-pressure passage 282, and a second low-pressure passage 272 are formed such that fluid being compressed is bypassed.

The second bypass structure is a structure to allow fluid, which is first bypassed by the first bypass structure and starts to be again compressed, to be bypassed. For this purpose, the first bypass port 241 is formed inner than the second bypass port 242 as viewed in twist of the stationary spiral wrap 17 in the spiral direction.

In case where fluid is bypassed by the second bypass structure, the amount of fluid compressed through the scroll compressor is further reduced than that of when only the first bypass structure is opened.

Also, as a third bypass structure, a third control passage 303, a third control valve 293, a third high-pressure passage 283, and a third low-pressure passage 273 are formed such that fluid being compressed is bypassed. Although not shown in the drawing due to the limitations of the drawing, a third bypass port, a third check valve, and a third bypass passage can be further included.

The third bypass structure is a structure to allow fluid, which is first bypassed by the first bypass structure and the second bypass structure and starts to be again compressed, to be bypassed. For this purpose, the third bypass port (not shown) is formed inner than the first and second bypass ports 241 and 242 as viewed in twist of the stationary spiral wrap 17 in the spiral direction.

Hereinbelow, the formation positions of the bypass ports 241, 242 and 243 will be described in detail.

Figure 9:
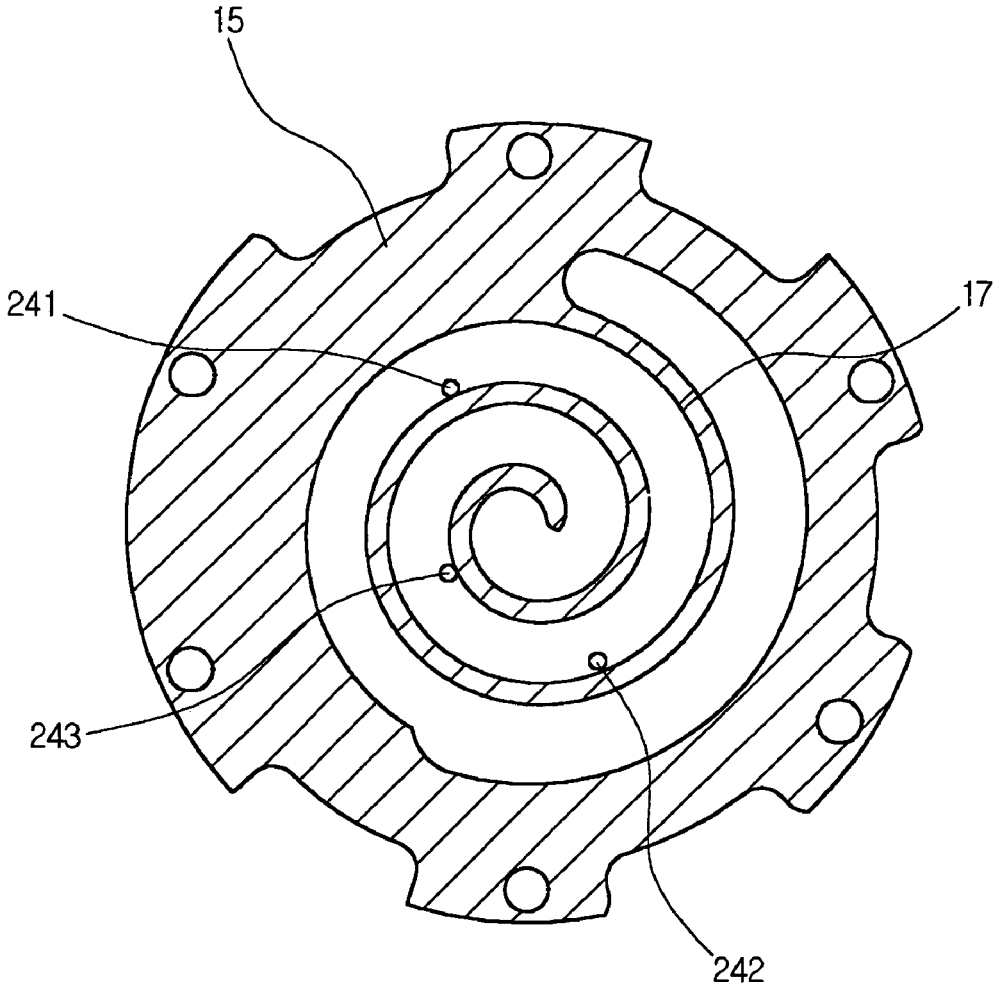
FIG. 9 is a schematic view conceptually illustrating a position where the bypass port depicted in FIG. 8 is formed.

FIG. 9 illustrates the formation positions of the bypass ports according to the present invention.

Referring to FIG. 9, at an inner portion of the stationary scroll member 15, a stationary spiral wrap 17 is formed. In a spiral space formed along the spiral wrap 17, in an order entering from an external side to an interior side, a first bypass port 241, a second bypass port 242, and a third bypass port 243 are formed. The first and third bypass ports 241 and 243 permit the fluid inhaled through the second intake space to be bypassed. The second bypass port 242 is bypassed through the second intake space. As described previously, the first bypass port and the second bypass port can be discriminated on the basis of a contact surface between the stationary spiral wrap and the orbiting spiral wrap.

It should be however understood that the formation positions of the plurality of bypass ports 241, 242, 243 are not limited to that described in FIG. 9. In other words, the bypass ports may be formed at different positions in excess of three. Also, the positions where they are formed at either the first intake space or the second intake space may be different according to a concrete compression volume requested by the scroll compressor.

For example, when the bypass ports are formed at the positions proposed in FIG. 9, variation in the compression capacity that is implementable can be proposed as in the below table 1.

TABLE 1

| Compression volume | $1^{st}$ bypass port | $2^{nd}$ bypass port | $3^{rd}$ bypass port |
|---|---|---|---|
| 100% | Closed | Closed | Closed |
| 80% | Open | Closed | Closed |
| 60% | Open | Open | Closed |
| 40% | Open | Open | Open |

The bypass ports are opened or closed depending on the pressure applied to the check valve, so that the compression capacity compressed by the scroll compressor can be varied at four different stages. In other words, when the inventive scroll compressor is applied to a cooling system or a heat pump system, the scroll compressor can be operated at three or more different compression volumes in the concrete compression volume.

In the meanwhile, among the opened bypass ports 241, 242 and 243, when the innermost bypass port is opened along the stationary spiral wrap 17, the compression volume can be set to an expected value regardless of whether the bypass port positioned outside the innermost bypass port is opened or not. For example, when it is intended to operate the scroll compressor at a compression volume of 40%, if the third bypass port 243 is opened, the operation of the scroll compressor is not affected by whether the first bypass port 241 is opened or closed. However, in a state that the first bypass port 241 is closed, since motor power used for compressing fluid is increased as much, an overall efficiency of the apparatus is lowered, which is undesirable.

It is noted that when the innermost bypass port is opened along the stationary spiral wrap 17, what the compression volume can be set to an expected value regardless of whether the bypass port positioned outside the innermost bypass port is opened or not is limited to the bypass ports formed in the same space. In detail, the plurality of bypass ports formed in the first intake space influence only the first intake space, and the plurality of bypass ports formed in the second intake space influence only the second intake space. For example, in the first and third bypass ports 241 and 243 formed in the second intake space, when the third bypass port 243 is opened, the first bypass port 241 can obtain a fixed compression volume regardless of whether the third bypass port 243 is opened or closed.

Figure 10:
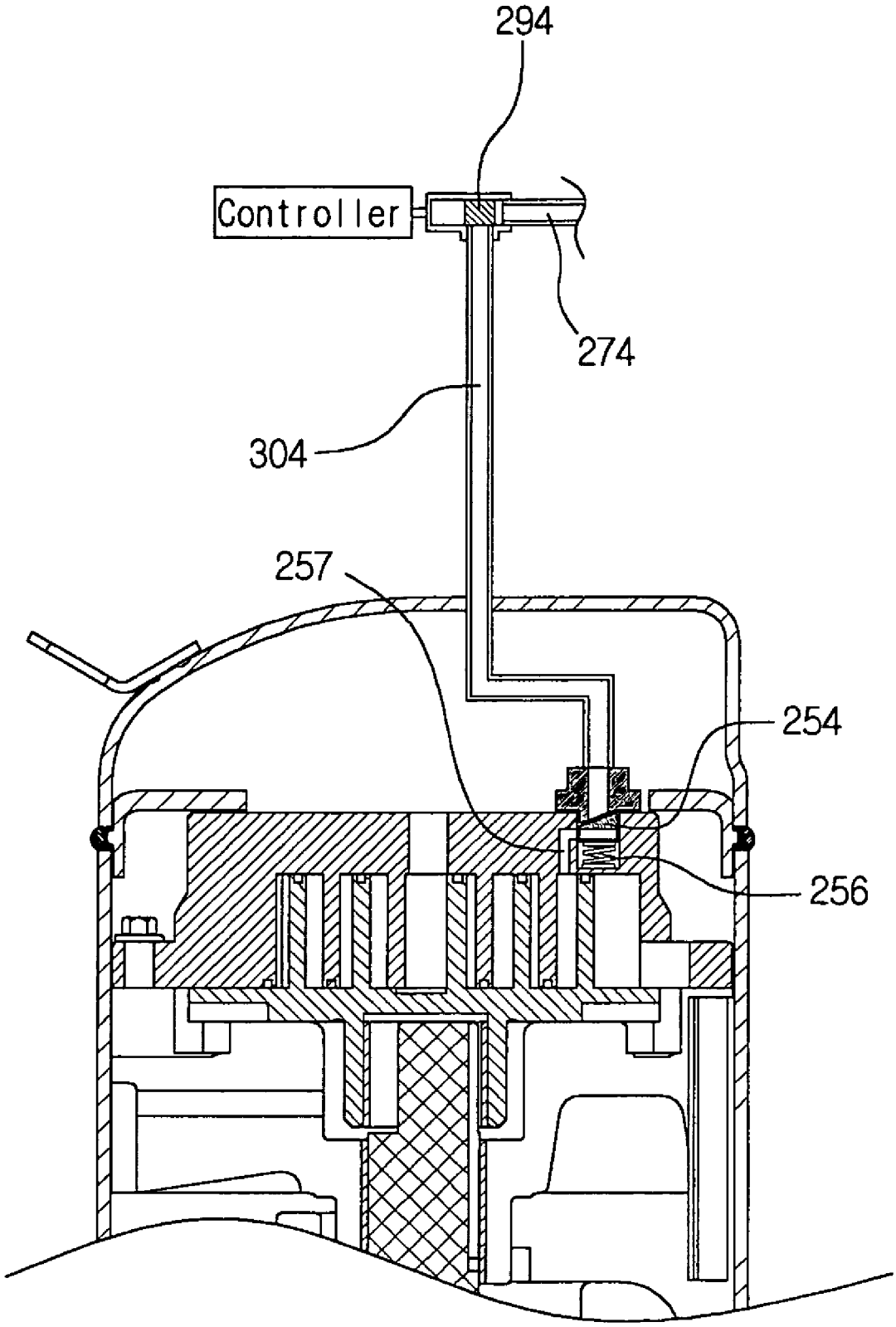
FIG. 10 is a sectional view of a scroll compressor according to another embodiment of the present invention.

FIG. 10 illustrates a variable capacity scroll compressor according to another embodiment of the present invention.

Referring to FIG. 10, the scroll compressor according to the present embodiment of the present invention may be identical in its general constitution to that described with reference to FIGS. 1 to 10 in which the bypass port is formed.

It should be however understood that high-pressure fluid is additively applied to the bypass port to thereby enhance the efficiency of the scroll compressor, unlike the fluid being bypassed through the bypass port.

In detail, the scroll compressor is configured to include an injection port 257 formed on a predetermined position of a stationary scroll member of the scroll compressor, and extending to an inner compression space from an outer circumference of the stationary scroll member, an injection valve 254 formed on a fluid passage of the injection port 257, an elastic member 256 for applying an elastic force in a state that high pressure is not applied to control the operation of the injection valve 254, a fourth control passage 304 extending to an outside of the scroll compressor from the injection port 257, a fourth control valve 294 formed on a predetermined position of the control passage 304, and a condenser-connecting passage 274 extending from the fourth control valve 294 and connected with a condenser formed as an element of a cooling/heat pump system.

In the meanwhile, while the injection valve 254, the injection port 257, the elastic member 256 and so forth are exemplarily shown to illustrate the concept of the present embodiment, it is apparent that their sectional shapes are not restricted only to those proposed in FIG. 10. In detail, the fourth control passage 304 is sufficient only if it extends from the fourth control valve 294 to the injection valve 254. The injection port 257 is sufficient if one end thereof is in contact with the compression space of the stationary scroll member and extends to an outer space of the stationary scroll member. The injection valve 254 is sufficient only if it is formed on a fluid passage of the injection port 257 to intermittently control the flow of fluid. Also, the elastic member 256 is sufficient if it provides a predetermined elastic force to such a degree that when a high pressure bypassed from the condenser is applied to the injection valve 254, fluid can flow through the fluid passage, and when a high pressure is not applied to the injection valve 254, fluid does not flow through the fluid passage. The elastic member is not restricted only to the spring structure shown in FIG. 10.

As aforementioned, the operational state of the scroll compressor that can further enhance the compression efficiency of the scroll compressor can be named 'injection operation.'

Hereinbelow, injection operation will be described in detail.

The injection operation is characterized in that fluid is compressed to a higher pressure by bypassing a high-pressure fluid that has passed or is passing through the condenser using a compressor and thereby permitting more work to be applied.

In detail, when a high pressure from the condenser is applied to the fourth control valve 294 being in an opened state, the injection valve 254 is opened by a pushing force of the high-pressure fluid overcoming an elastic force of the elastic member 256 so that the fluid can be injected into a compression space of the stationary scroll member through the injection port 257.

However, when a high pressure from the condenser is not applied to the fourth control valve 294 being in a closed state, the injection valve 254 is closed by the elastic force of the elastic member 256. Hence, the high-pressure fluid cannot be injected into the compression space and the fluid being compressed in the compression space of the stationary scroll member cannot be bypassed too.

Finally, according to the opening/closing of the fourth control valve 294, the compression condition of the scroll compressor may be varied, and the variation in the compression condition allows the compression volume of the scroll compressor to be changeable. For instance, in case a small compression volume is required, the fourth control valve 294 is closed for a normal operation. In case a large compression volume is required, the fourth control valve 294 is opened such that the scroll compressor can be operated in a higher-pressure state.

Figure 11:
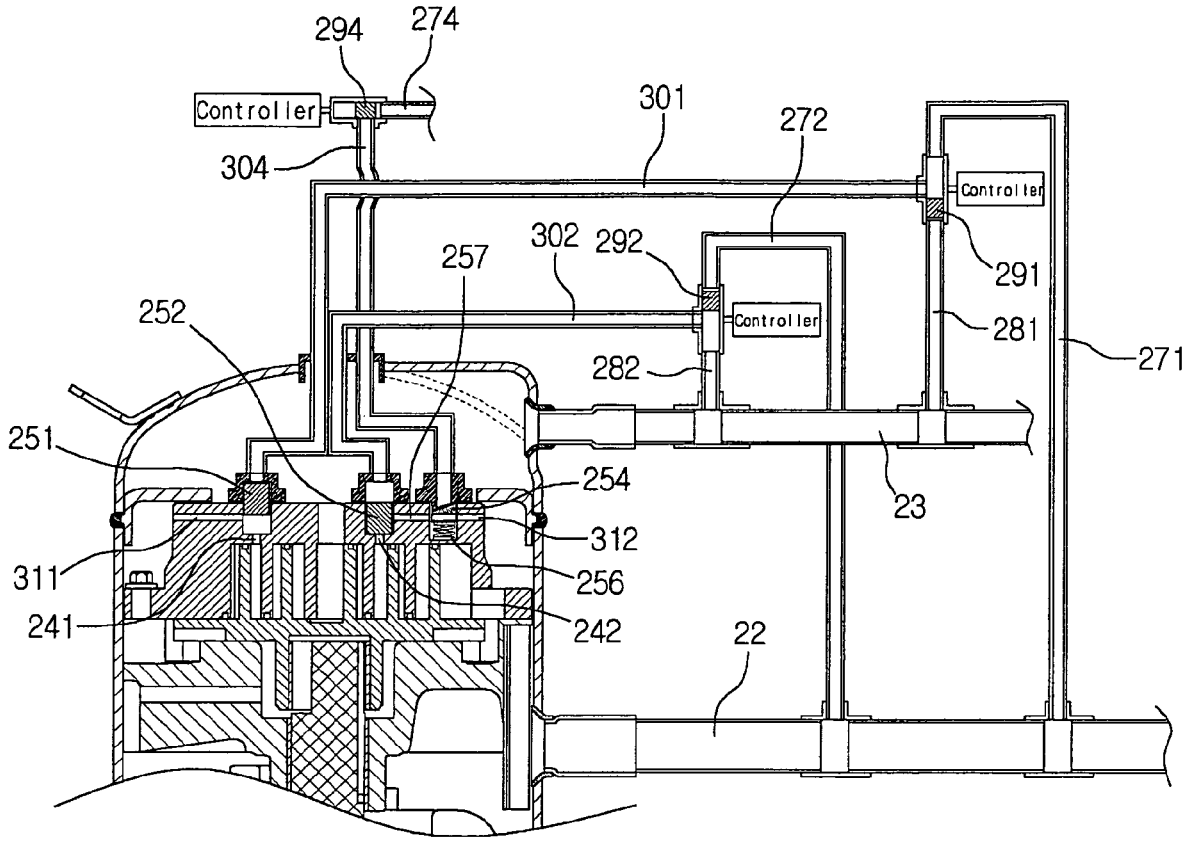
FIGS. 11 to 14 are sectional views of scroll compressors that can be implemented when a plurality of compression variable capacity structures are concurrently applied.

FIGS. 11 to 14 illustrate a scroll compressor in which a plurality of elements for varying compression volume are concurrently employed. Specifically, FIG. 11 is a sectional view of a scroll compressor in which elements for symmetric/asymmetric operation and injection operation are employed together with other elements.

Referring to FIG. 11, the scroll compressor includes a condenser-connecting passage 274 for injection operation, a fourth control valve 294, a fourth control passage 304, an injection valve 254, an injection port 257, an elastic spring 256. Here, an upper end portion of the injection valve 254 is formed obliquely to allow a high-pressure fluid bypassed from the condenser to be guided toward the bypass port 257.

Also, for the symmetric/asymmetric operation, first and second low-pressure passages 271 and 272, first and second control passages 301 and 302, first and second high-pressure passages 281 and 282, first and second control valves 291 and 292, first and second check valves 251 and 252, first and second bypass ports 241 and 242, an intake passage 22 and an exhaust passage 23 are formed as aforementioned. It should be however understood that in order for the fluid being compressed to be bypassed through a plurality of points formed at the scroll compressor, one or two or more bypass ports and a fluid bypass passage related to the bypass ports can be naturally formed. Operation of the check valves 251 and 252 is naturally controlled by fluid pressure applied to the check valves 251 and 252.

In particular, an upper end portion of the injection valve 254 is formed obliquely. The structure of the injection valve 254 is sufficient only if, when high pressure of the condenser is applied, the injection valve 254 guides the high pressure to a compression space, and when high pressure is not applied, the injection valve 254 bypasses the fluid.

Also, to reduce a loss in the pressure of fluid supplied from the condenser, the injection port 257 can be connected with the bypass port nearest to a center of the scroll member. If separate injection valve and injection port for injection operation are formed and the injection port is not connected with the bypass port, the injection port can be formed at a center portion of the scroll member within a range that does not influence the operation of the scroll compressor. In addition, to prevent a loss in pressure, it is desirable to form the injection port at a position nearer to the center portion of the scroll member than other bypass ports.

Hence, when the injection valve 254 is moved downward, the fourth control passage 304 communicates with the injection port 257 so that high-pressure fluid can flow. However, when the injection valve 254 is moved upward, the injection port 257 communicates with the second bypass passage 312 through a passage formed penetrating the injection valve 254 so that the fluid being compressed through the second check valve 252 can be bypassed. However, even in this case, when the second check valve 252 is closed, the fluid being compressed cannot pass through the second bypass passage 312.

In the meanwhile, on the drawings, the first bypass port 241 is formed outer than the second bypass port 242 on the basis of the stationary scroll member.

In a state shown in FIG. 11, the first check valve 251 is opened, and the second check valve 252 and the injection valve 254 are closed. In this state, some of fluid being compressed may be bypassed. Thus, the operation of the scroll compressor in a state where some of fluid being compressed may be bypassed is named 'standard operation condition.'

Figure 12:
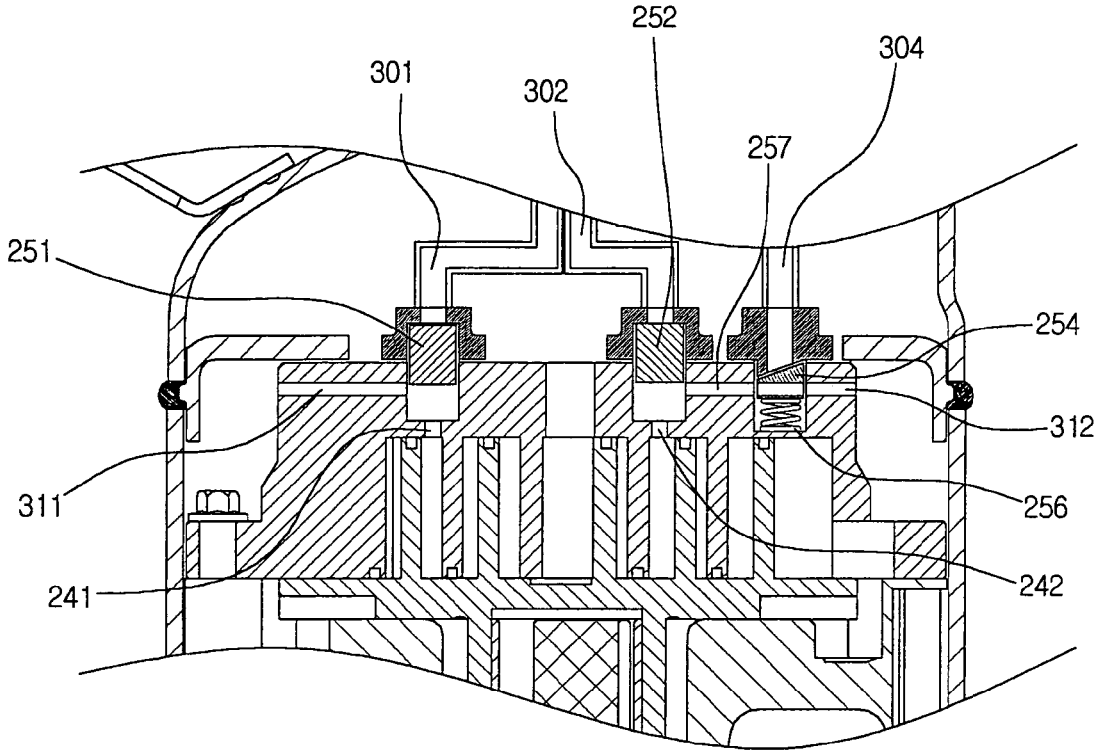

In a state shown in FIG. 12, the first check valve 251 and the second check valve 252 are opened, and the injection valve 254 is closed. In this state, since the fluid being compressed is bypassed through the second check valve 252 as well as through the first check valve 251, the compression volume by the scroll compressor becomes smaller than that in the standard operation condition. This operation condition is named 'bypass operation condition.'

Figure 13:
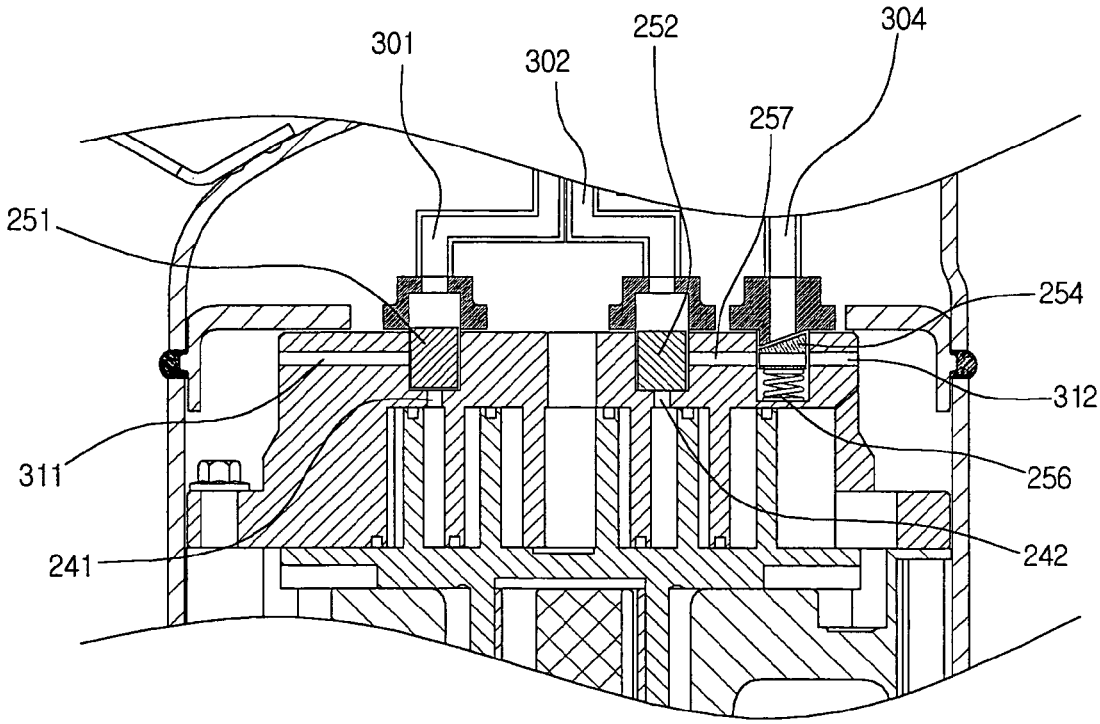

In a state shown in FIG. 13, the first check valve 251, the second check valve 252 and the injection valve 254 are all closed. In this state, since the fluid being compressed in the scroll compressor is not bypassed at all, the compression volume of the operation condition is larger than that in the standard operation condition or the bypass operation condition.

In case two bypass ports are formed in an opposite direction with respect to the approximate center of the stationary scroll member, they will be formed asymmetric in a direction with respect to the center of the scroll member, which is named 'asymmetric operation condition.'

Figure 14:
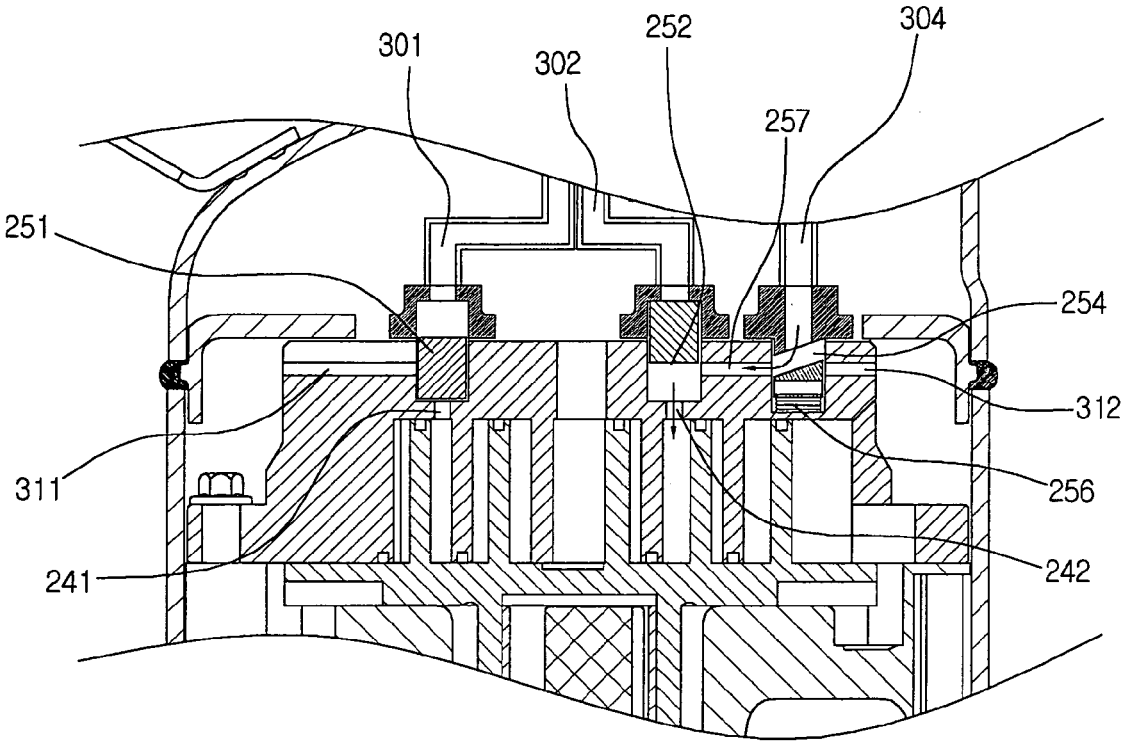

In a state shown in FIG. 14, the first check valve 251 is closed, and the second check valve 252 and the injection valve 254 are opened. Hence, the high-pressure fluid bypassed from the condenser is injected into the scroll compressor so that the compression volume of the scroll compressor becomes larger.

Due to the injection valve 254 having a physically oblique upper end portion, there is not fluid bypassed through the second bypass passage 312. Instead, the fluid injected through the fourth control passage 304 is again injected into the inside of the compression space of the scroll compressor through the injection port and the second bypass port 242. This operation state can be called 'asymmetric/injection operation condition.'

The constructions shown in FIGS. 11 to 14 are only modifications of the present invention. It is natural that the scroll compressor can be operated in many compression volume states by forming a plurality of bypass ports, or by forming a plurality of injection ports, or by forming the injection valve as a separate part having no relation with other bypass ports.

The aforementioned operation conditions can be summarized as the below table 2.

TABLE 2

| Operation condition | Comparison of compression volume |
|---|---|
| Asymmetric/injection operation condition | 130% |
| Asymmetric operation condition | 115% |
| Standard operation condition | 100% |
| Bypass operation condition | 40% |

In table 2, a state that one bypass port is opened and fluid is bypassed corresponds to the standard operation condition having the compression volume of 100%. Other operation conditions can be compared with the standard operation condition on the basis of the compression volume.

Thus, when compared with a case where only the bypass port is formed or a case where only the injection port is formed, the scroll compressor can be operated in multi-stages having various compression volumes.

Thus, by discriminating the operation condition in multi-stages, the operation states of the scroll compressor can be applied discriminated in multi-stages depending on the load condition. Accordingly, the usage efficiency of the scroll compressor can be further enhanced.

As described previously, since the compression volume can be varied in multi-stages, the scroll compressor can be operated more properly in the compression volume requested by a cooling system or a heat pump system.

Especially, since the injection operation and the bypass operation can be applied concurrently, a much wider volume in an upper and lower range can be implemented compared with the scroll compressor to which identical size and output are applied.

Also, in the variable capacity scroll compressor according to the present invention, it is possible to vary the compression volume in multi-stages using a bypass function, which can be realized by a simple structure, without varying the RPM of the compression motor.

In addition, since the valve for realizing the capacity variation of the scroll compressor is designed to be controlled by fluid pressure that is not still compressed in the compressing part and fluid pressure that is compressed in the compressing part without adding additional components, the manufacturing cost of the scroll compressor can be saved.

Further, since the scroll compressor can be operable in multi-stage compression volumes, it is possible to operate the scroll compressor at the volume that is most proper for a system.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A variable capacity scroll compressor comprising:

a control passage branched from a condenser and extending to a compression space of the scroll compressor such that high-pressure fluid of the condenser flows therethrough;

an injection port having one end contacting the control passage and a second end contacting the compression space of the scroll compressor;

an injection valve provided at the injection port to allow fluid to flow to the compression space of the scroll compressor when the high-pressure fluid of the condenser is applied from the control passage, while preventing the fluid from flowing when the high-pressure fluid of the condenser is not applied from the control passage to the compression space of the scroll compressor;

one or more bypass ports provided along the compression space of a scroll member, the one or more bypass ports allowing fluid in compression to be bypassed at one or more points;

a bypass passage having one end connected to the one or more bypass ports and a second end connected to a lower pressure side inside the compressor, wherein the injection valve has a body having a predetermined hole so that the fluid in compression can be bypassed through the bypass passage depending on a motion of the injection valve;

a check valve configured to selectively connect the bypass passage to the one or more bypass ports, wherein the injection valve and the check valve are connected with each other by the injection port; and a control valve configured to allow at least high-pressure fluid of an exhaust passage of the scroll compressor to be selectively applied to the check valve to move the check valve to one of opening and closing positions.

2. The variable capacity scroll compressor according to claim 1, wherein the injection port is connected with the bypass passage.

3. The variable capacity scroll compressor according to claim 1, wherein the injection valve has an inclined upper side to guide flow of the fluid from the condenser into the compression space of the scroll compressor.

4. The variable capacity scroll compressor according to claim 1, wherein the injection port is connected with the bypass port towards an innermost location of the scroll member.

5. The variable capacity scroll compressor according to claim 1, wherein the bypass passage has the second end connected with an intake chamber of the scroll compressor.

6. The variable capacity scroll compressor according to claim 1, further comprising an elastic member to guide movement of the injection valve.

7. The variable capacity scroll compressor according to claim 1, wherein the bypass port is closer than the injection port to a center of the scroll member.

* * * * *